US009903546B2

(12) United States Patent
Parman

(10) Patent No.: US 9,903,546 B2
(45) Date of Patent: Feb. 27, 2018

(54) PORTABLE LIGHTING ASSEMBLY

(71) Applicant: Bruce Parman, Cottonwood, AZ (US)

(72) Inventor: Bruce Parman, Cottonwood, AZ (US)

( * ) Notice: Subject to any disclaimer, the term of this patent is extended or adjusted under 35 U.S.C. 154(b) by 35 days.

(21) Appl. No.: 15/080,902

(22) Filed: Mar. 25, 2016

(65) Prior Publication Data

US 2017/0276305 A1 Sep. 28, 2017

(51) Int. Cl.

| | |
|---|---|
| ***F21V 3/00*** | (2015.01) |
| ***F21V 23/00*** | (2015.01) |
| ***F21V 21/30*** | (2006.01) |
| ***F21L 14/04*** | (2006.01) |
| *F21V 5/04* | (2006.01) |

(52) U.S. Cl.

CPC ..... *F21L 14/04* (2013.01); *F21V 3/00* (2013.01); *F21V 21/30* (2013.01); *F21V 5/04* (2013.01); *F21V 23/001* (2013.01)

(58) Field of Classification Search

None

See application file for complete search history.

(56) References Cited

U.S. PATENT DOCUMENTS

| | | | | |
|---|---|---|---|---|
| 2,580,699 | A | 1/1952 | Pfetzing | |
| 4,442,477 | A * | 4/1984 | Hennessey | B60Q 1/12 180/900 |
| D275,895 | S | 10/1984 | Dietzen | |
| 4,511,880 | A * | 4/1985 | Stanuch | B60Q 1/2611 340/472 |
| 4,987,522 | A * | 1/1991 | Miyano | B60Q 1/24 280/756 |
| 5,392,201 | A | 2/1995 | Morley et al. | |
| 6,761,474 | B1 | 7/2004 | Race | |
| 7,273,215 | B1 | 9/2007 | Smith | |
| 8,632,231 | B1 | 1/2014 | McCullough et al. | |
| 2003/0063475 | A1* | 4/2003 | Simmons | B60Q 1/24 362/526 |
| 2005/0169001 | A1* | 8/2005 | Farrow | B60Q 1/124 362/476 |
| 2006/0028819 | A1 | 2/2006 | Shankland et al. | |

* cited by examiner

*Primary Examiner* — Ashok Patel

(57) ABSTRACT

A portable lighting assembly includes a cart that may be rolled along a support surface. A bracket is coupled to the cart. A lighting unit is movably coupled to the bracket. The lighting unit is positioned at a selected orientation with respect to the panel. Thus, the lighting unit may emit light in the selected orientation with respect to the panel.

11 Claims, 4 Drawing Sheets

PORTABLE LIGHTING ASSEMBLY

BACKGROUND OF THE DISCLOSURE

Field of the Disclosure

The disclosure relates to lighting devices and more particularly pertains to a new lighting device that combines a work light with a cart.

SUMMARY OF THE DISCLOSURE

An embodiment of the disclosure meets the needs presented above by generally comprising a cart that may be rolled along a support surface. A bracket is coupled to the cart. A lighting unit is movably coupled to the bracket. The lighting unit is positioned at a selected orientation with respect to the panel. Thus, the lighting unit may emit light in the selected orientation with respect to the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
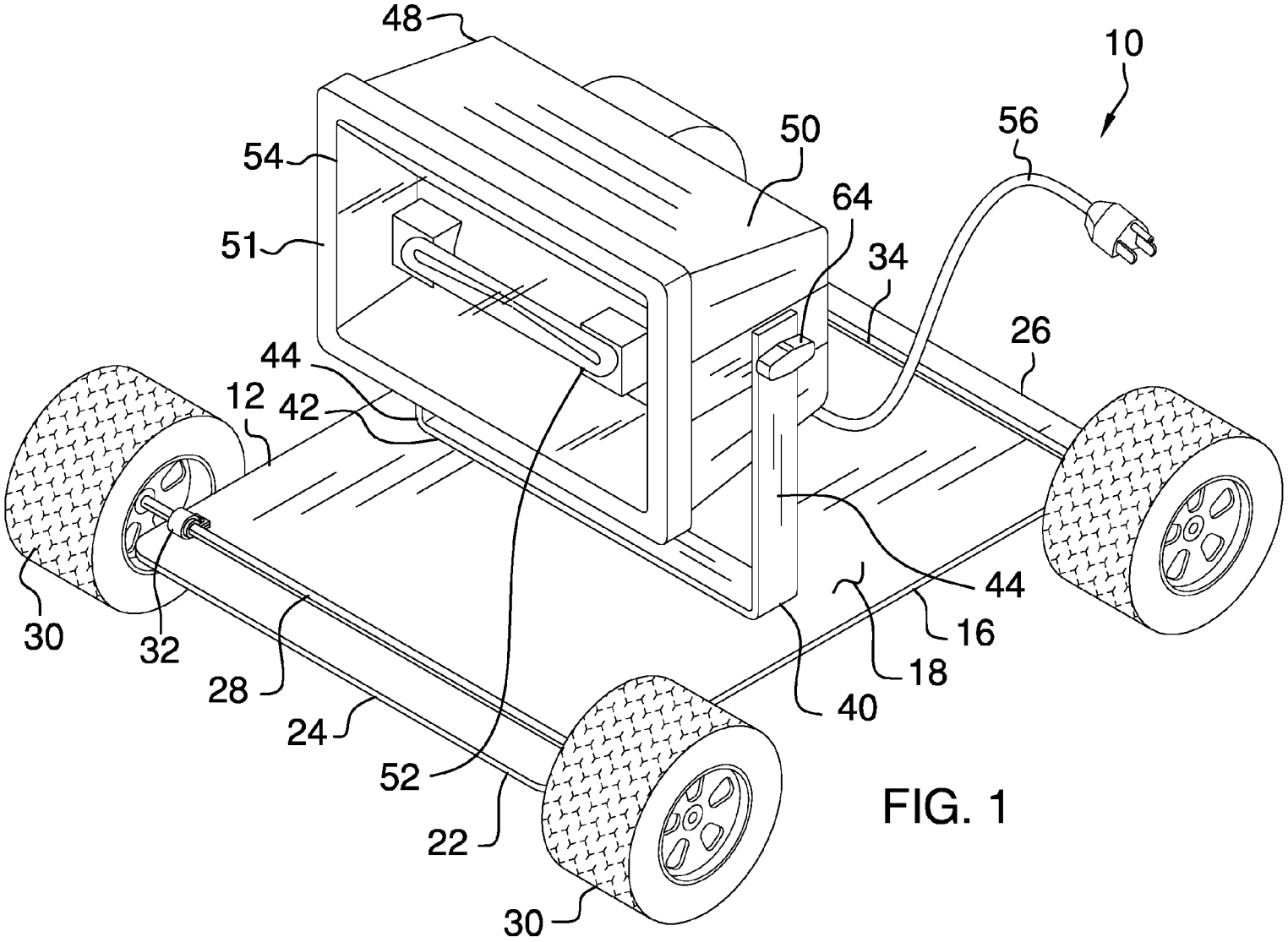
FIG. 1 is a front perspective view of a portable lighting assembly according to an embodiment of the disclosure.
Figure 2:
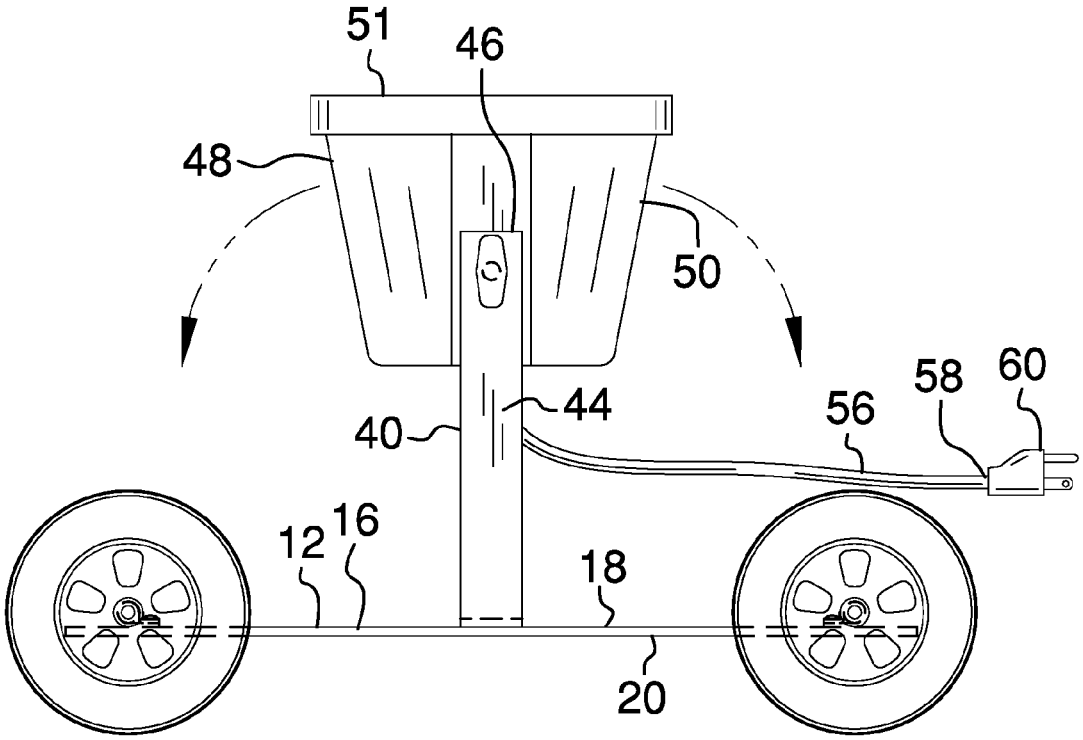
FIG. 2 is a left side view of an embodiment of the disclosure.
Figure 3:
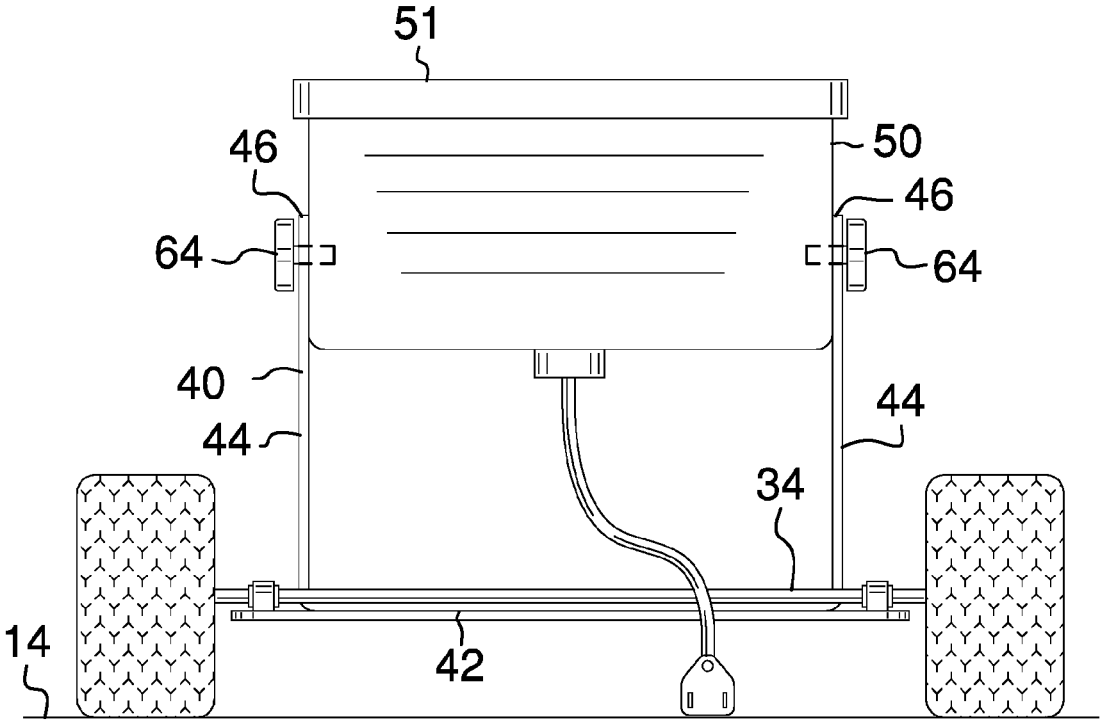
FIG. 3 is a back view of an embodiment of the disclosure.
Figure 4:
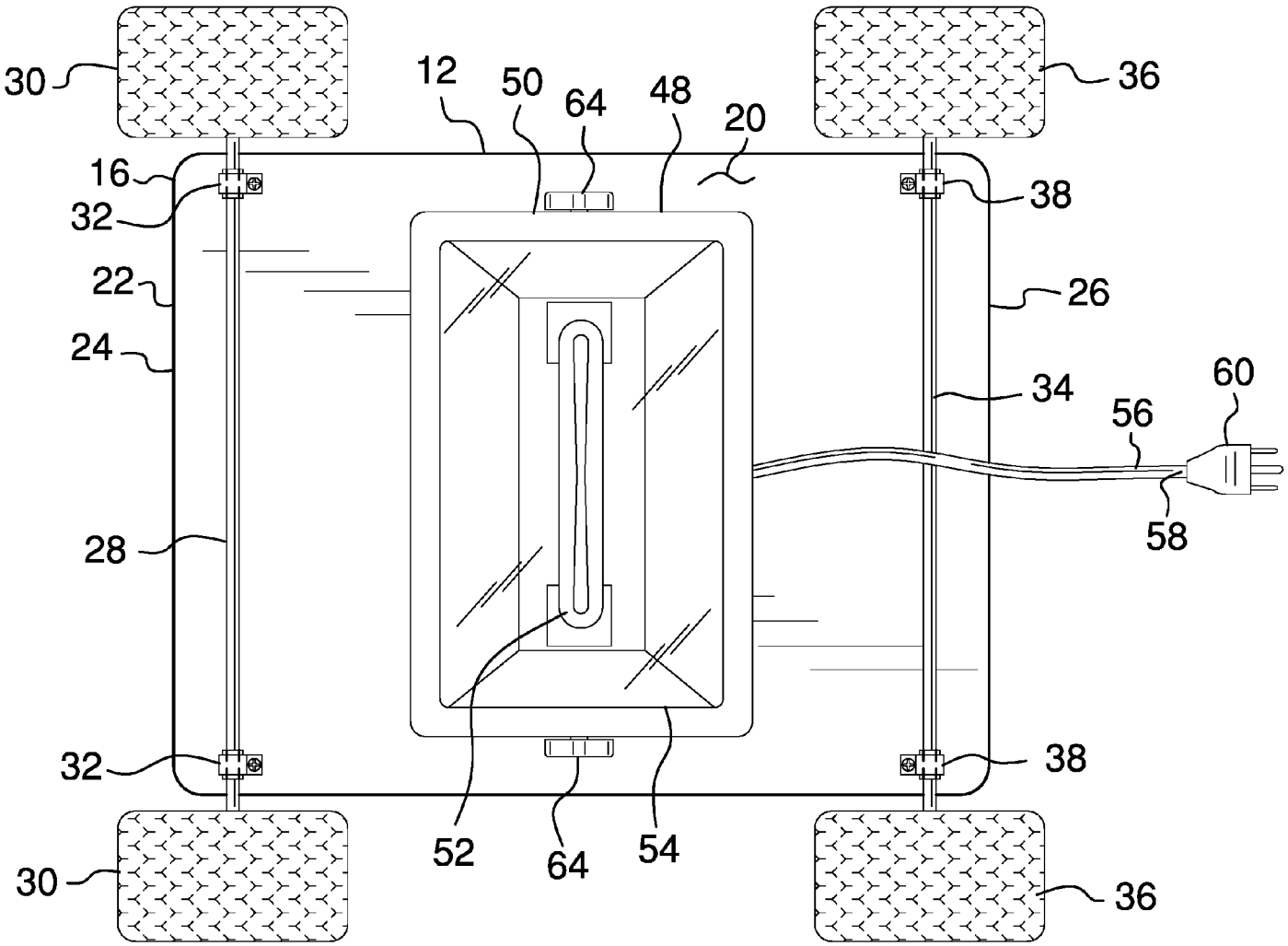
FIG. 4 is a top view of an embodiment of the disclosure.
Figure 5:
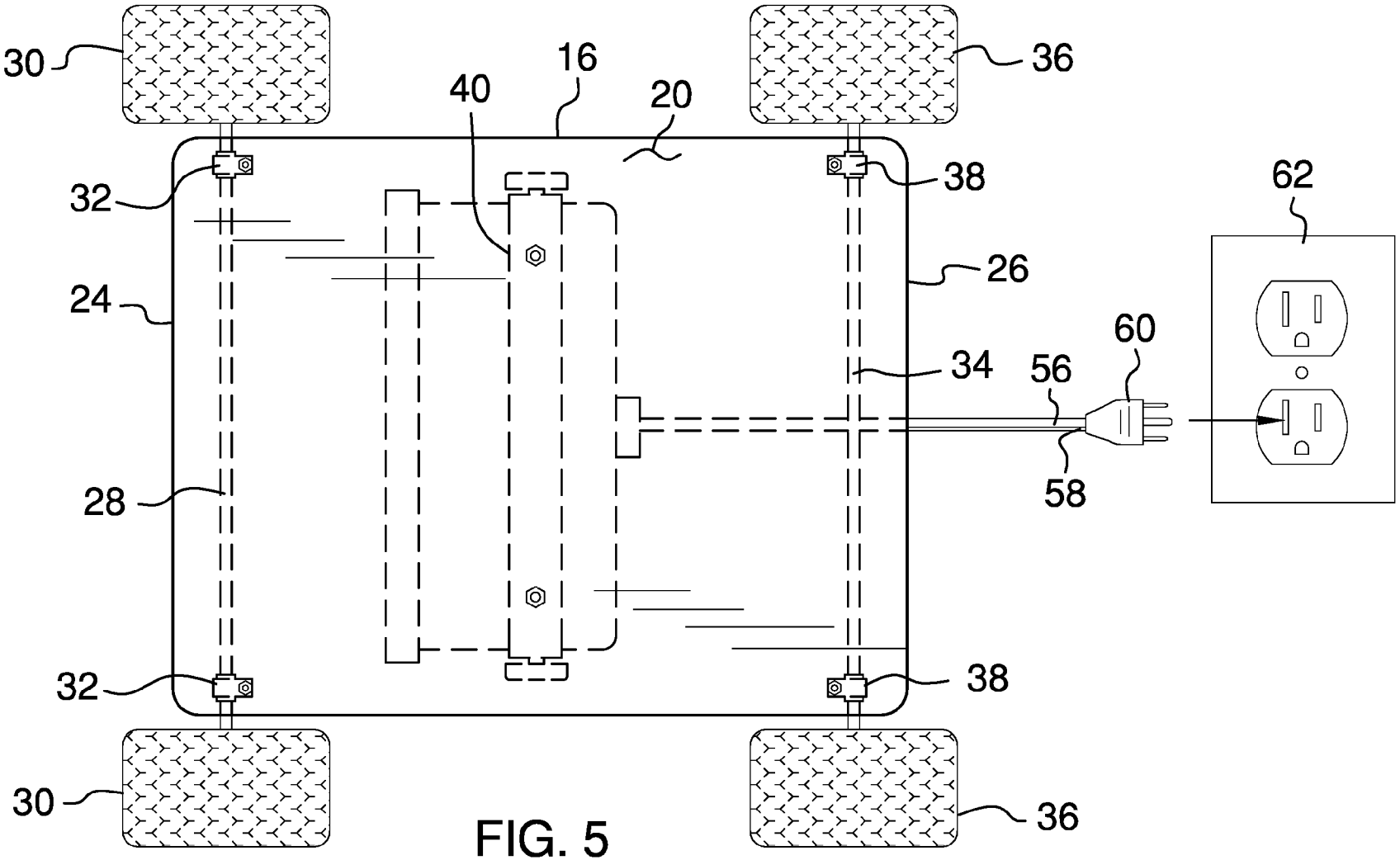
FIG. 5 is a bottom phantom view of an embodiment of the disclosure.

With reference now to the drawings, and in particular to FIGS. 1 through 5 thereof, a new lighting device embodying the principles and concepts of an embodiment of the disclosure and generally designated by the reference numeral 10 will be described.

As best illustrated in FIGS. 1 through 5, the portable lighting assembly 10 generally comprises a cart 12 that may be rolled along a support surface 14. The cart 12 comprises a panel 16 that has a top surface 18, a bottom surface 20 and a peripheral edge 22 extending between the top surface 18 and the bottom surface 20. The peripheral edge 22 has a front side 24 and a back side 26. The support surface 14 may comprise ground or the like.

A first axle 28 is coupled to the panel 16 and the first axle 28 is positioned on the top surface 18. The first axle 28 is positioned closer to the front side 24 than the back side 26. The first axle 28 is coextensive with the front side 24. A pair of first wheels 30 is provided and each of the first wheels 30 is rotatably coupled to the first axle 28. Thus, each of the first wheels 30 may roll along the support surface 14.

A pair of first straps 32 is provided. Each of the first straps 32 is wrapped around the first axle 28. The first straps 32 are spaced apart from each other. Each of the first straps 32 is coupled to the top surface 18 of the panel 16 such that the first axle 28 is retained on the panel 16.

A second axle 34 is coupled to the panel 16 and the second axle 34 is positioned on the top surface 18. The second axle 34 is positioned closer to the back side 26 than the front side 24. The second axle 34 is coextensive with the back side 26. A pair of second wheels 36 is provided and each of the second wheels 36 is rotatably coupled to the second axle 34. Thus, each of the second wheels 36 may roll along the support surface 14. Each of the pair of first wheels 30 and the pair of second wheels 36 may comprise inflatable rubber tires or the like. Thus, the cart 12 may be rolled along uneven terrain.

A pair of second straps 38 is provided and each of the second straps 38 is wrapped around the second axle 34. The second straps 38 are spaced apart from each other. Each of the second straps 38 is coupled to the top surface 18 of the panel 16. Thus, the second axle 34 is retained on the panel 16.

A bracket 40 is coupled to the cart 12. The bracket 40 is positioned on the top surface 18 of the panel 16. The bracket 40 comprises a central member 42 extending between a pair of uprights 44. The uprights 44 are spaced apart from each other and each of the uprights 44 has a distal end 46 with respect to the central member 42. The central member 42 is coupled to the top surface 18 having each of the uprights 44 extending upwardly from the panel 16. The bracket 40 is centrally positioned on the panel 16 and the central member 42 is coextensive with the front side 24 and the back side 26.

A lighting unit 48 is movably coupled to the bracket 40 and the lighting unit 48 is positioned at a selected orientation with respect to the panel 16. Thus, the lighting unit 48 may emit light in the selected orientation with respect to the panel 16. The lighting unit 48 comprises a housing 50. The housing 50 is movably coupled between the uprights 44 and the housing 50 has an open end 51. The housing 50 is manipulated on the bracket 40 to direct the open end 51 in a selected direction with respect to the panel 16.

A light emitter 52 is positioned within the housing 50. Thus, the light emitter 52 may emit light outwardly from the open end 51. The light emitter 52 may comprise a halogen light bulb or the like. A lens 54 is coupled to the housing 50 and the lens 54 is positioned to cover the open end 51. The lens 54 is comprised of a translucent material.

A power cord 56 extends outwardly from the housing 50 and the power cord 56 is electrically coupled to the light emitter 52. The power cord 56 has a distal end 58 with respect to the housing 50 and a plug 60 is electrically coupled to the distal end 58. The plug 60 may be electrically coupled to a power source 62. The power source 62 may comprise an electrical outlet or the like.

A pair of fasteners 64 is provided. Each of the fasteners 64 extends through an associated one of the uprights 44 and engages the housing 50. Thus, each of the fasteners 64 may be manipulated. Each of the fasteners 64 is selectively tightened such that the lighting unit 48 is retained at the selected orientation with respect to the panel 16. Each of the fasteners 64 may comprise a thumb screw or the like. Moreover, each of the fasteners 64 is positioned adjacent to the distal end of the associated upright 44.

In use, the cart 12 is rolled along the support surface 14 and the cart 12 positioned adjacent to a darkened area. The housing 50 is manipulated to direct to the open end 51 of the housing 50 toward the darkened area. The plug 60 is electrically coupled to the power source 62 and the light emitter 52 illuminates the darkened area. The plug 60 is electrically uncoupled from the power source 62 and the cart 12 is moved away from the darkened area.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable lighting assembly comprising:

a cart being configured to be rolled along a support surface, said cart comprising:

a panel having a top surface, a bottom surface and a peripheral edge extending between said top surface and said bottom surface, said peripheral edge having a front side and a back side, a first axle being coupled to said panel, said first axle being positioned on said top surface, said first axle being positioned closer to said front side than said back side, said first axle being coextensive with said front side, a pair of first wheels, each of said first wheels being rotatably coupled to said first axle wherein each of said first wheels is configured to roll along the support surface, a pair of first straps, each of said first straps being wrapped around said first axle, said first straps being spaced apart from each other, each of said first straps being coupled to said top surface of said panel such that said first axle is retained on said panel, a second axle being coupled to said panel, said second axle being positioned on said top surface, said second axle being positioned closer to said back side than said front side, said second axle being coextensive with said back side, a pair of second wheels, each of said second wheels being rotatably coupled to said second axle wherein each of said second wheels is configured to roll along the support surface, and a pair of second straps, each of said second straps being wrapped around said second axle, said second straps being spaced apart from each other, each of said second straps being coupled to said top surface of said panel such that said second axle is retained on said panel;

a bracket being coupled to said cart, said bracket being positioned on said top surface of said panel, said bracket comprising a central member extending between a pair of uprights, said uprights being spaced apart from each other, each of said uprights having a distal end with respect to said central member, said central member being coupled to said top surface having each of said uprights extending upwardly from said panel, said bracket being centrally positioned on said panel, said central member being coextensive with said front side and said back side;

a lighting unit being movably coupled to said bracket such that said lighting unit is positioned at a selected orientation with respect to said panel wherein said lighting unit is configured to emit light in the selected orientation with respect to said panel, said lighting unit comprising:

a housing being movably coupled between said uprights wherein said housing is configured to be manipulated, said housing having an open end, a light emitter being positioned within said housing wherein said light emitter is configured to emit light outwardly from said open end, a lens being coupled to said housing, said lens being positioned to cover said open end, and a power cord extending outwardly from said housing, said power cord being electrically coupled to said light emitter, said power cord having a distal end with respect to said housing, said distal end having a plug being electrically coupled thereto, said plug being configured to be electrically coupled to a power source; and a pair of fasteners, each of said fasteners extending through an associated one of said uprights engaging said housing wherein each of said fasteners is configured to be manipulated, each of said fasteners being selectively tightened such that said lighting unit is retained at the selected orientation with respect to said panel.

2. A portable lighting assembly comprising:

a cart being configured to be rolled along a support surface, said cart including a panel;

a bracket being coupled to said cart;

a lighting unit being movably coupled to said bracket such that said lighting unit is positioned at a selected orientation with respect to said panel wherein said lighting unit is configured to emit light in the selected orientation with respect to said panel; and wherein said cart includes said panel having a top surface, a bottom surface and a peripheral edge extending between said top surface and said bottom surface, said peripheral edge having a front side and a back side;

a first axle being coupled to said panel, said first axle being positioned on said top surface, said first axle being positioned closer to said front side than said back side, said first axle coextensive with said front side; and a second axle being coupled to said panel, said second axle being positioned on said top surface, said second axle being positioned closer to said back side than said front side, said second axle being coextensive with said back side.

3. The assembly according to claim 2, further comprising a pair of first wheels, each of said first wheels being rotatably coupled to said first axle wherein each of said first wheels is configured to roll along the support surface.

4. The assembly according to claim 2, further comprising a pair of first straps, each of said first straps being wrapped around said first axle, said first straps being spaced apart from each other, each of said first straps being coupled to said top surface of said panel such that said first axle is retained on said panel.

5. The assembly according to claim 2, further comprising a pair of second wheels, each of said second wheels being rotatably coupled to said second axle wherein each of said second wheels is configured to roll along the support surface.

6. The assembly according to claim 2, further comprising pair of second straps, each of said second straps being wrapped around said second axle, said second straps being spaced apart from each other, each of said second straps being coupled to said top surface of said panel such that said second axle is retained on said panel.

7. A portable lighting assembly comprising:

a cart being configured to be rolled along a support surface, said cart including a panel;

a bracket being coupled to said cart; and a lighting unit being movably coupled to said bracket such that said lighting unit is positioned at a selected orientation with respect to said panel wherein said lighting unit is configured to emit light in the selected orientation with respect to said pan;

said panel having a top surface, a front side and a back side; and said bracket being positioned on said top surface of said panel, said bracket comprising a central member extending between a pair of uprights, said uprights being spaced apart from each other, each of said uprights having a distal end with respect to said central member, said central member being coupled to said top surface having each of said uprights extending upwardly from said panel, said bracket being centrally positioned on said panel, said central member being coextensive with said front side and said back side.

8. The assembly according to claim 7, further comprising a light emitter being positioned within a housing wherein said light emitter is configured to emit light outwardly from an open end of said housing.

9. The assembly according to claim 7, further comprising a lens being coupled to said housing, said lens being positioned to cover said open end.

10. The assembly according to claim 8, further comprising a power cord extending outwardly from said housing, said power cord being electrically coupled to said light emitter, said power cord having a distal end with respect to said housing, said distal end having a plug being electrically coupled thereto, said plug being configured to be electrically coupled to a power source.

11. The assembly according to claim 7, further comprising a pair of fasteners, each of said fasteners extending through an associated one of said uprights engaging said housing wherein each of said fasteners is configured to be manipulated, each of said fasteners being selectively tightened such that said lighting unit is retained at the selected orientation with respect to said panel.

* * * * *